United States Patent [19]

Hayes et al.

[11] Patent Number: 4,705,339

[45] Date of Patent: Nov. 10, 1987

[54] SEALED PLUG FOR A PRINTED CIRCUIT BOARD RECEPTACLE

[75] Inventors: Earl J. Hayes, Advance; Ralph M. Cooper, Clemmons, both of N.C.

[73] Assignee: AMP Incorporated, Harrisburg, Pa.

[21] Appl. No.: 876,525

[22] Filed: Jun. 19, 1986

[51] Int. Cl.[4] ..... H01R 13/432

[52] U.S. Cl. ..... 439/277; 439/559; 439/712; 439/747

[58] Field of Search ..... 339/17 LC, 220 R, 221 R, 339/221 M, 217 S, 258 R, 258 P, 94 R, 94 A, 94 C, 94 M, 206 R, 206 P, 207 R, 207 S, 126 R, 126 RS, 132 R, 132 B, 93 R, 93 C, 92 R, 92 M, 176 M, 65

[56] References Cited

U.S. PATENT DOCUMENTS

| | | | |
|---|---|---|---|
| 3,091,748 | 5/1963 | Takes et al. | 339/65 |
| 3,336,569 | 8/1967 | Nava | 339/94 M |
| 3,530,428 | 9/1970 | Zak | 339/217 S |
| 3,538,489 | 11/1970 | Bennett et al. | 339/217 S |
| 3,763,460 | 10/1973 | Hatschek | 339/217 S |
| 4,252,399 | 2/1981 | Bauerle | 339/217 S |
| 4,407,559 | 10/1983 | Meyer | 339/176 M |
| 4,589,721 | 5/1986 | Sedig et al. | 339/217 S |

FOREIGN PATENT DOCUMENTS

| | | | |
|---|---|---|---|
| 3302824 | 8/1984 | Fed. Rep. of Germany | 339/258 R |

*Primary Examiner*—John McQuade

*Attorney, Agent, or Firm*—Eric J. Groen

[57] ABSTRACT

A plug assembly comprises a housing member having a cavity at its forward end defined by a peripheral wall and a cavity wall, and a rear wall. The housing further includes contact receiving apertures extending between the cavity wall and the rear wall. An insert is locked in place in the forward cavity, the adjacent wall of the insert having standoff feet to define a gap between the cavity wall and insert wall. The insert has apertures in alignment with the apertures in the housing. The apertures within the insert include a shoulder facing the rear wall of the insert. A contact insertable into the apertures in the housing and insert has a lance which is locatable in the gap between the cavity wall and insert wall to lock the contact in place.

12 Claims, 15 Drawing Figures

540
548
552
542
546
550
510
572
570
574
460
500
502
464
466
410
498
490
496
444
446
448
420
450
454
474
478
452
456
450
430
470
498
500
448
434

460
472
474
5A
490
498
502
500
470
492
478

460
466
468
469
480
481
488
484
482
492
486
476
474
490
478
496
498
470
446
444
454
456
436
410
434
438
430
442
432

SEALED PLUG FOR A PRINTED CIRCUIT BOARD RECEPTACLE

FIELD OF THE INVENTION

The instant invention relates to a vibration resistant plug assembly for interconnecting to a receptacle mounted to a bulkhead, the receptacle having pin contacts mateable with socket contacts within the plug assembly.

BACKGROUND OF THE INVENTION

Prior Art

There is disclosed in U.S. Pat. No. 3,530,428 to Zak an electrical connector having a locking lance for locking two mating electrical terminals 104, 106 within housing halves 100, 102, respectively. However in Zak, the housing halves are not two piece, therefore due to molding limitations the slots 50, 52 can only be one diameter or increasing in diameter as the slot progresses outwardly towards the front faces of the housings. To prevent the terminals from being pulled out, a fixed tab 118, 124 is includeable on each of the terminals, lying outside of the envelope of the terminal body portion which rests on internal tapered seats 144, 156 within the cavities. This type of terminal could not be utilized in an application where the terminal must be inserted through a sealing grommet, as the insertion of the terminal would tear the grommet apertures upon insertion therethrough.

There is disclosed in U.S. Pat. No. 4,252,399 a socket contact 1 locked within a two piece housing, although to prevent the terminal from being outwardly through the front face of the housing a crimped bead 16 is includable on the rearward portion of the contact. Therefore, this contact could not be used in an application where sealing is required as the bead 16 would tear or stretch a sealing aperture through which the terminal is being placed. The socket ends 7, 8 could not be utilized to bear against the backside of the forward mounting plate, as the force against the backside surface would be detrimental to the effectiveness of the contacts' resiliency.

SUMMARY OF THE INVENTION

The subject invention includes a two piece plug housing including an insert and a housing member having an insert receiving cavity. The cavity is defined by a forward surface and has contact receiving apertures extending from the forward surface to a rearward section of the plug housing.

The insert includes a front face, a rearward face, and standoff feet extending from the rearward face. The insert is insertable into the insert receiving cavity and lockable in place therein, the standoff feet of the insert abutting the forward surface of the insert cavity providing a gap therebetween. The insert further includes apertures extending from the front face through the rear face in alignment with the apertures in the plug housing. The apertures in the insert include a shoulder facing towards the rearward face defined by a reduced diameter of the aperture at the front face.

The instant invention further includes a socket contact insertable through the rearward portion of the plug housing and into the aperture of the insert. The contact comprises a band portion at the forward end and a barrell portion, with a constricted portion extending therebetween. The contact further includes a lance struck from the barrel portion and extending through an opening on the opposite side of the barrel portion.

The invention also includes a sealing grommet installed in the rearward portion of the plug housing having apertures in alignment with the apertures in the insert and plug housing.

The socket contacts are installed by inserting a pin through the contact until the lance is within the envelope defined by the barrel portion of the contact. The contact is then insertable through the rearward portion of the plug housing until the contact forward end abuts the shoulder within the insert. The pin is then pulled away from the contact which allows the lance to bias upward to its original position, out of the envelope defined by the contact barrel portion, and extends in the gap between the insert and plug housing, locking the contact in place.

BRIEF DESCRIPTION OF THE DRAWINGS

FIG. 3 is a perspective view of the socket contact.

FIG. 8 is a cross-sectional view of the receptacle and the plug assembly through lines 8—8 of FIG. 1.

DETAILED DESCRIPTION OF THE PREFERRED EMBODIMENT

The subject matter disclosed herein is related to application Ser. No. 876,970, entitled "Printed Circuit Board Receptacle for Sealed Connector"; application Ser. No. 876,549, entitled "Receptacle and Plug Assembly"; and application Ser. No. 876,159, entitled "Sealing Member for Bulkhead Connector", all filed concurrently herewith. The above-mentioned applications are incorporated herein by reference.

Figure 1:
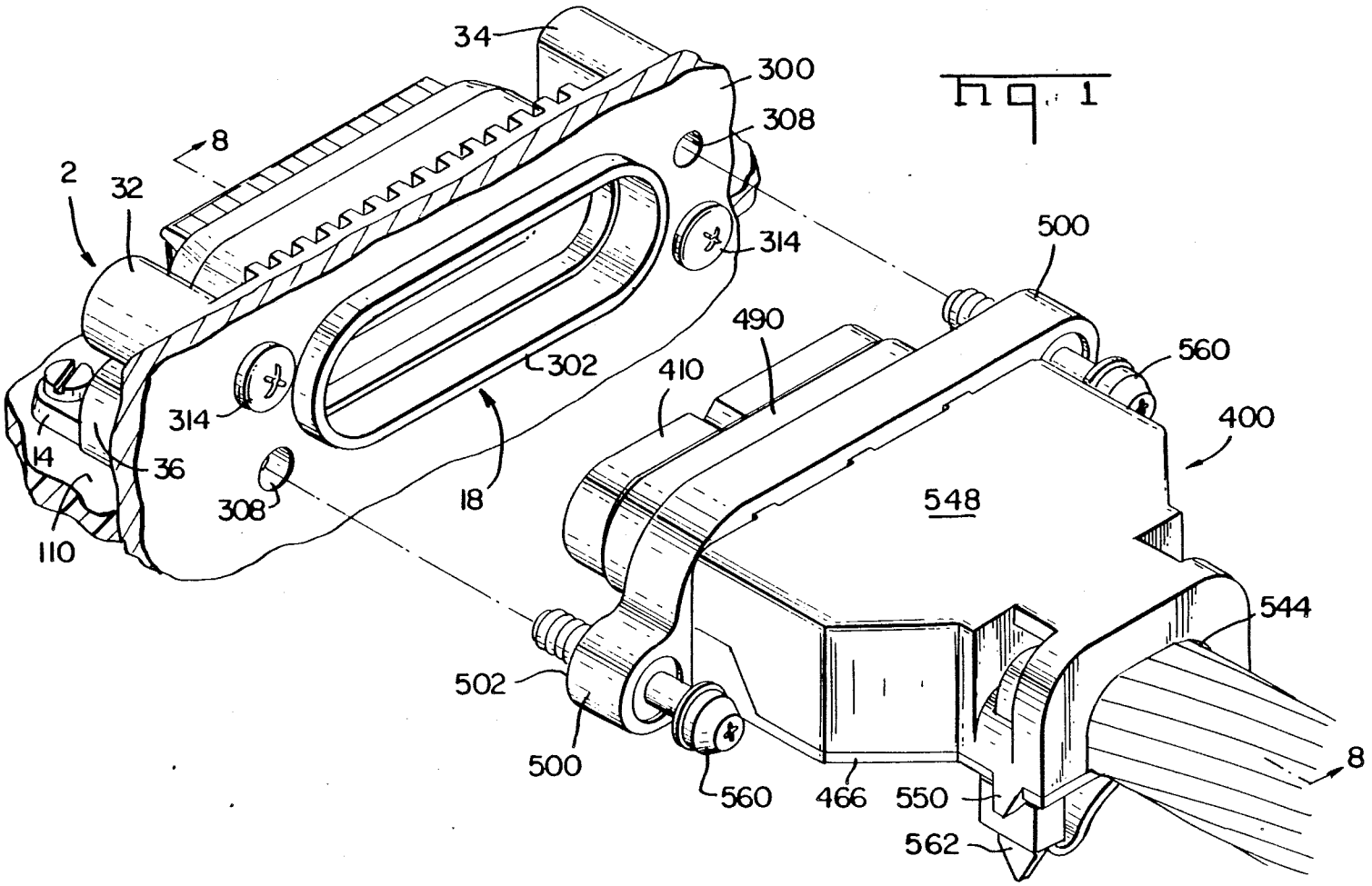
FIG. 1 shows the plug assembly of the instant invention poised for receipt in a mateable receptacle assembly.
Figure 2:
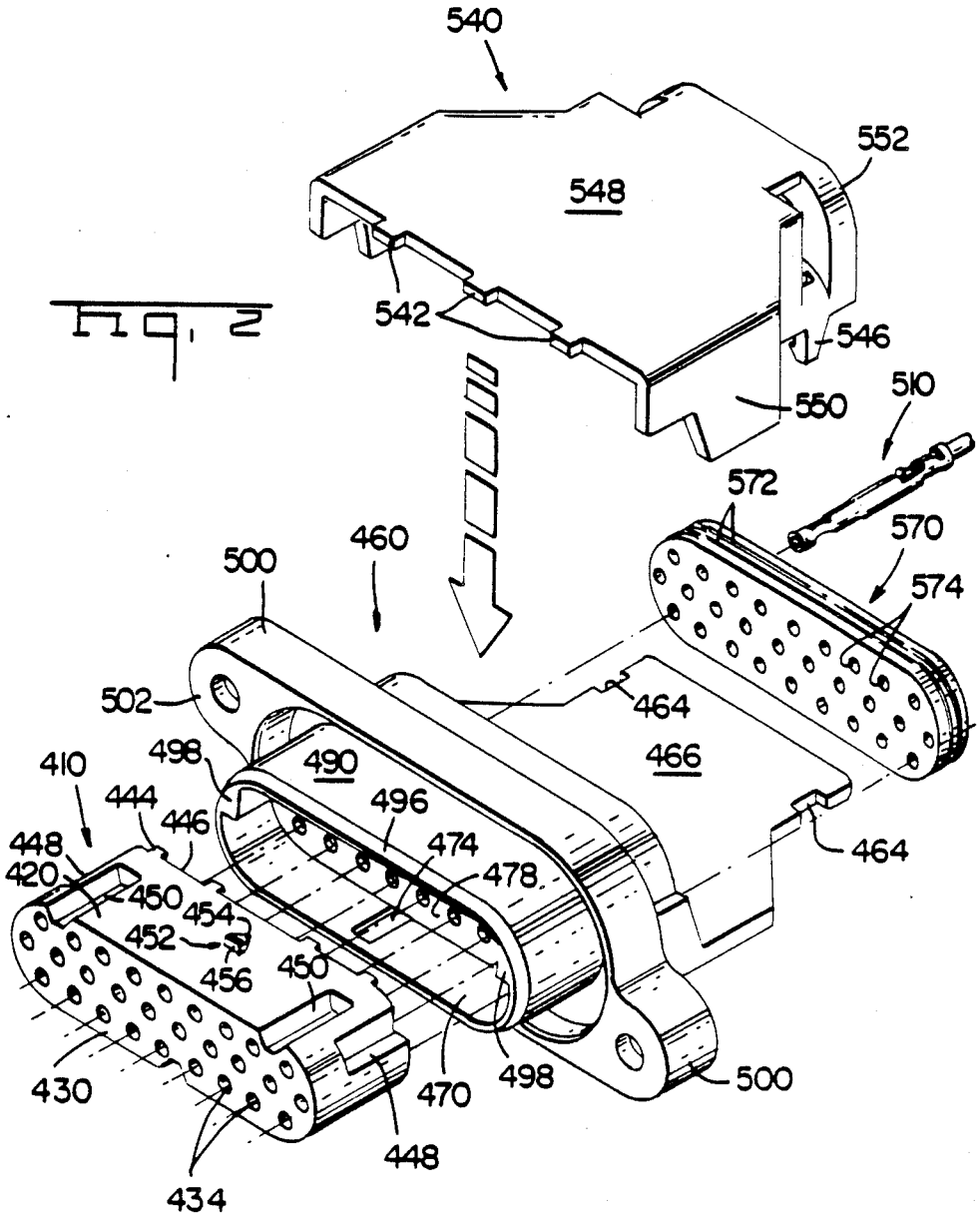
FIG. 2 shows the components of the plug assembly exploded away from the plug housing.

Referring to FIG. 1, the subject plug 400 is shown poised for receipt through the opening in the bulkhead 300 into the plug-receiving cavity 18 of receptacle 2. Receptacle 2 is shown mounted to a printed circuit board 110 and then enclosed within a sealed box (not shown), one of the walls being shown as bulkhead 300. Referring more specifically to FIG. 2, the subject plug includes an insert 410, a plug housing 460 and a cover portion 540 and a plurality of socket contacts 510.

As shown in FIG. 2, extending from the back surface 446 are a plurality of semicircular standoff feet 444. Located around the periphery of the insert 410 are two alignment channels 448, which extend from the back surface 446 and extend towards the front wall 430. Also extending around the periphery of the insert 410 are polarizing channels 450 extending from the front surface 430 extending rearwardly towards the back wall 446. Located on the top and bottom of surface 420 are two locking lugs 452, each lug having a ramp surface 454 and a locking surface 456.

Figures 4, 7:
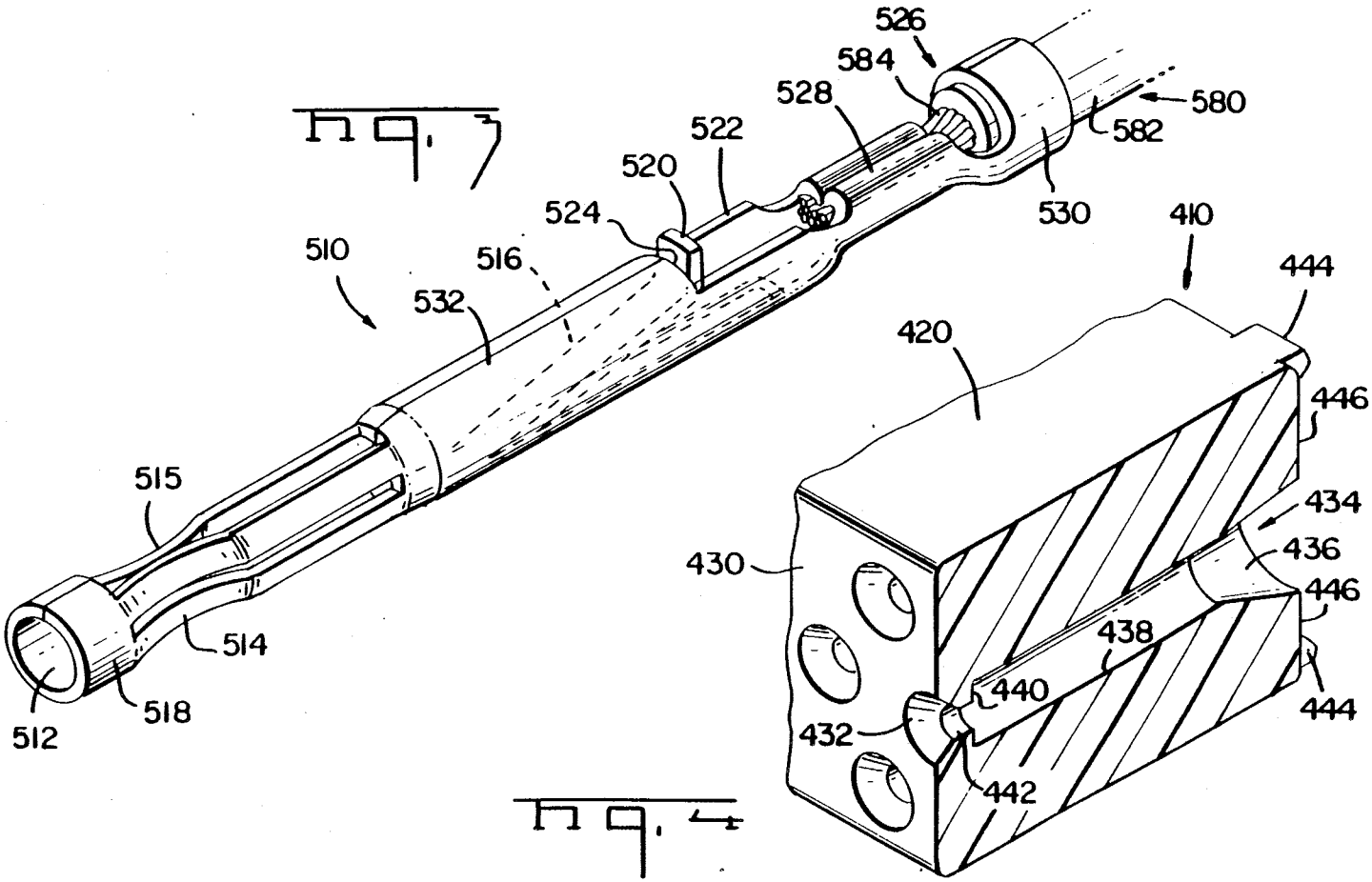
FIG. 4 is a cutaway view showing the internal structure of the insert.
FIG. 7 is similar to that of FIG. 6 showing the contact locked in place.

Referring more specifically to FIG. 4, the insert 410 is shown in greater detail. The insert 410 is oval-shaped in nature having surface 420 peripherally surrounding the insert 410. Insert 410 further comprises a front wall 430 and a back wall 446. A contact receiving cavity 434 extends from the back face 446 through to the front face 430. The cavity 434 is defined by a contact lead-in portion 436, a straight portion 438, a pin-receiving diameter 442 and a pin-receiivng chamfered surface 432. Shoulder 440 is defined by the decrease in diameter between straight section 438 and the pin-receiving diameter 432.

Figure 5:
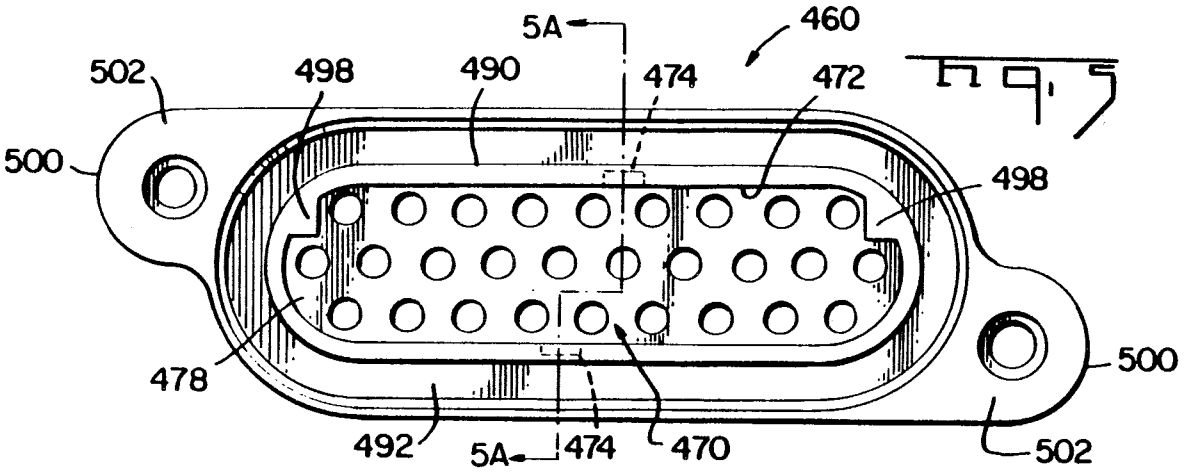
FIG. 5 is a front plan view of the plug housing.
Figure 5A:
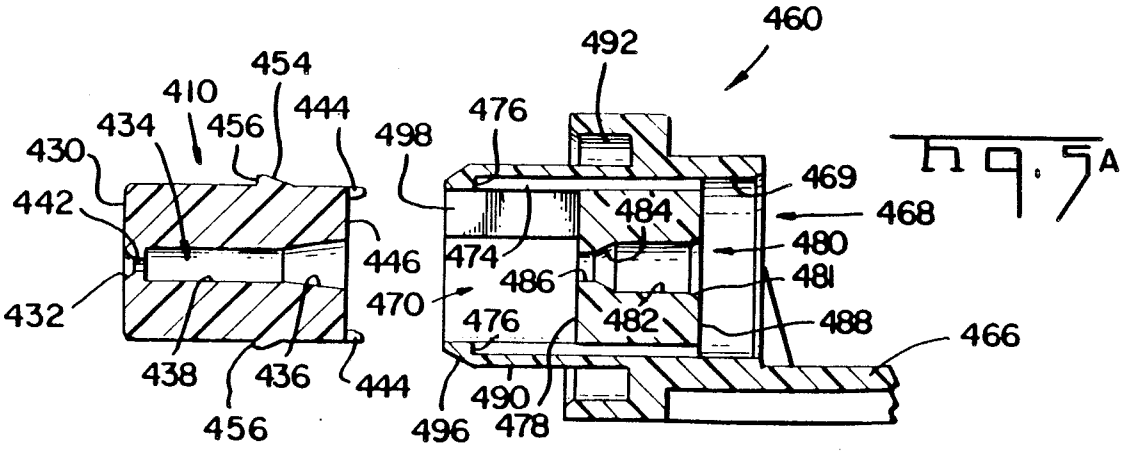
FIG. 5A is a cross-sectional view through lines 5A—5A of FIG. 5, including an exploded cross section of the insert.

Referring now to FIGS. 5 and 5A, the plug housing 460 is shown in greater detail. The housing 460 first comprises an insert receiving cavity 470 which is defined by oval-shaped interior surface 472 and a surface 478. Two alignment lugs 498 are located on either side of the cavity 470. As shown in FIG. 5A, the housing 460 further comprises a gasket-receiving cavity 468 defined by an oval-shaped peripheral surface 469 and a flat surface 488. A contact receiving aperture 480 extends from the flat surface 488 through to the surface 478, the aperture defined by contact lead-in section 481, a straight section 482, a lance lead-in section 484 and a bore 486. A locking lug channel 474 extends from the flat surface 488 to the forward portion of the housing 460, the termination of the channel being defined by a back surface 476.

Figure 2A:
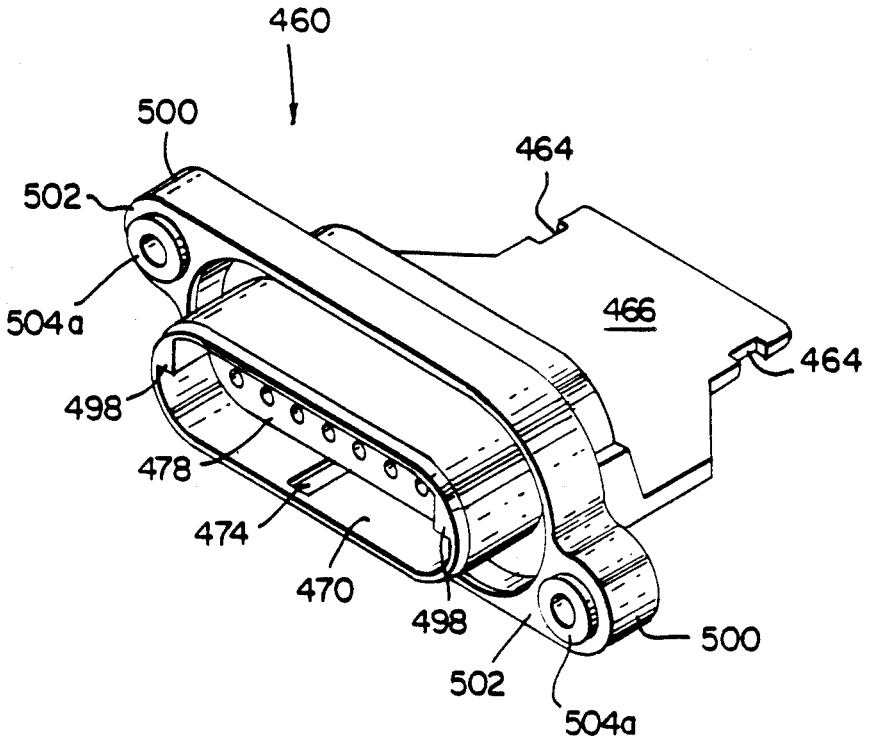
FIG. 2A shows a perspective view of a plug housing of an alternative embodiment.

As shown in FIG. 5, the exterior of the plug housing 460 includes a peripheral surface 490 and a plug lead-in surface 496. Also located on the exterior of the housing 460 is an O-ring receiving groove 492 which extends peripherally around the housing. As shown in FIG. 2, the preferred embodiment includes a planar mounting surface 502. Alternatively, the mounting surface of another embodiment includes mounting bosses 504A, as shown in FIG. 2A. Extending from the lower portion of the housing 460 on either embodiment is a wire-receiving surface 466 having a mounting lug 464 located on either side edge.

Referring now to FIG. 3 the socket contact 510 is shown in greater detail. The socket contact 510 includes a socket end 518 having a pin-receiving opening 512 and a constricted portion 514. The constricted portion 514 comprises individual resilient beams 515, which are fixed at each end, by the socket end 518 at the forward end and by the contact barrel portion 532 at its rearward end. The contact 510 further includes a locking lance 516 struck from, and extending upwardly from, the lower portion of the contact 510 and has a lance end 520 bent upwardly which extends through an envelope defined by the barrel portion 532 of the contact 510 at lance opening 522. The lance end 520 extends outwardly through the lance opening 522 and is adjacent to a surface 524 of the contact 510. The socket contact 510 further comprises a wire terminating portion 526 including a conductor terminating area 528 and a strain relief section 530.

Referring again to FIG. 2, the cover 540 is shown as including top wall 548, sidewalls 550 and endwall 552. Extending forwardly from the top wall 548 are latching tabs 542 and extending downwardly from the sidewalls 550 are latches 546. A wire bundle exit area 544 (FIG. 1) is located within the endwall 522.

To assemble the plug assembly, the insert 410 is placed in the insert-receiving cavity 470 of the plug housing 460, the alignment channels 448 mating with the respective alignment lugs 498, as shown in FIG. 2. The insert 410 is slid rearwardly in the cavity 470 until the standoff feet 444 contact the wall 478 of the plug housing 460. The insert 410 will then be locked within the cavity as an upper locking lug 452 is disposed in an upper channel 474 and a lower locking lug 452 is disposed in a lower channel 474, locking surfaces 456 against back surfaces 476, as shown in FIG. 5A. When the insert 410 is completely inserted in the cavity 470, a forward portion of the insert 410 protrudes through the cavity 470, as best shown in FIG. 7. Furthermore, when the insert 410 is completely backed up against the wall 478, a gap exists between the surface 446 and the surface 478, the gap being the height of the standoff feet 444. With the insert 410 in place, each contact-receiving cavity 434 in the insert 410 is axially aligned with a contact-receiving hole 480 in the plug housing. The grommet 570 is then placed in a rearward cavity 468, each aperture 574 in the grommet 570 in axial alignment with the contact-receiving holes 434 and 480, as shown in FIG. 7.

The socket contacts 510 are then preferred for insertion into the respective cavities. As shown in FIG. 3, each individual conductor 580 is prepared by removing a portion of the insulation 582 and exposing the conductor 584. The prepared wire 580 is then installed in the wire terminating portion 526, the conductor lying in the conductor terminating area 528 and the insulation portion 582 lying in the strain relief section 530. The conductor terminating section 528 is then crimped onto the conductor providing an adequate electrical connection, while the strain relief section 530 is folded around the insulation to provide for a strain relief.

Figure 6:
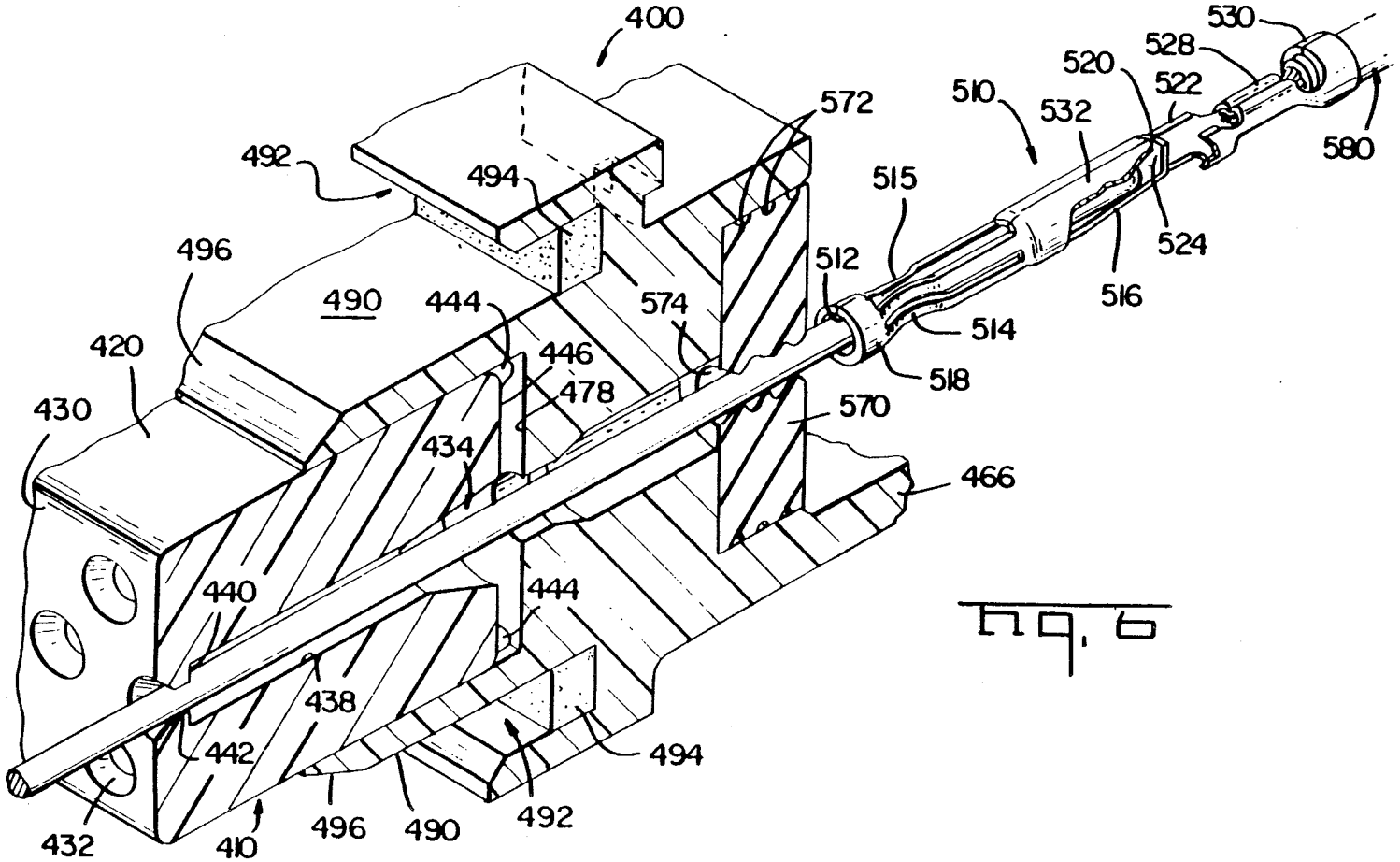
FIG. 6 shows a cutaway view of the assembled plug assembly and the insertion of the contact.
Figure 7:
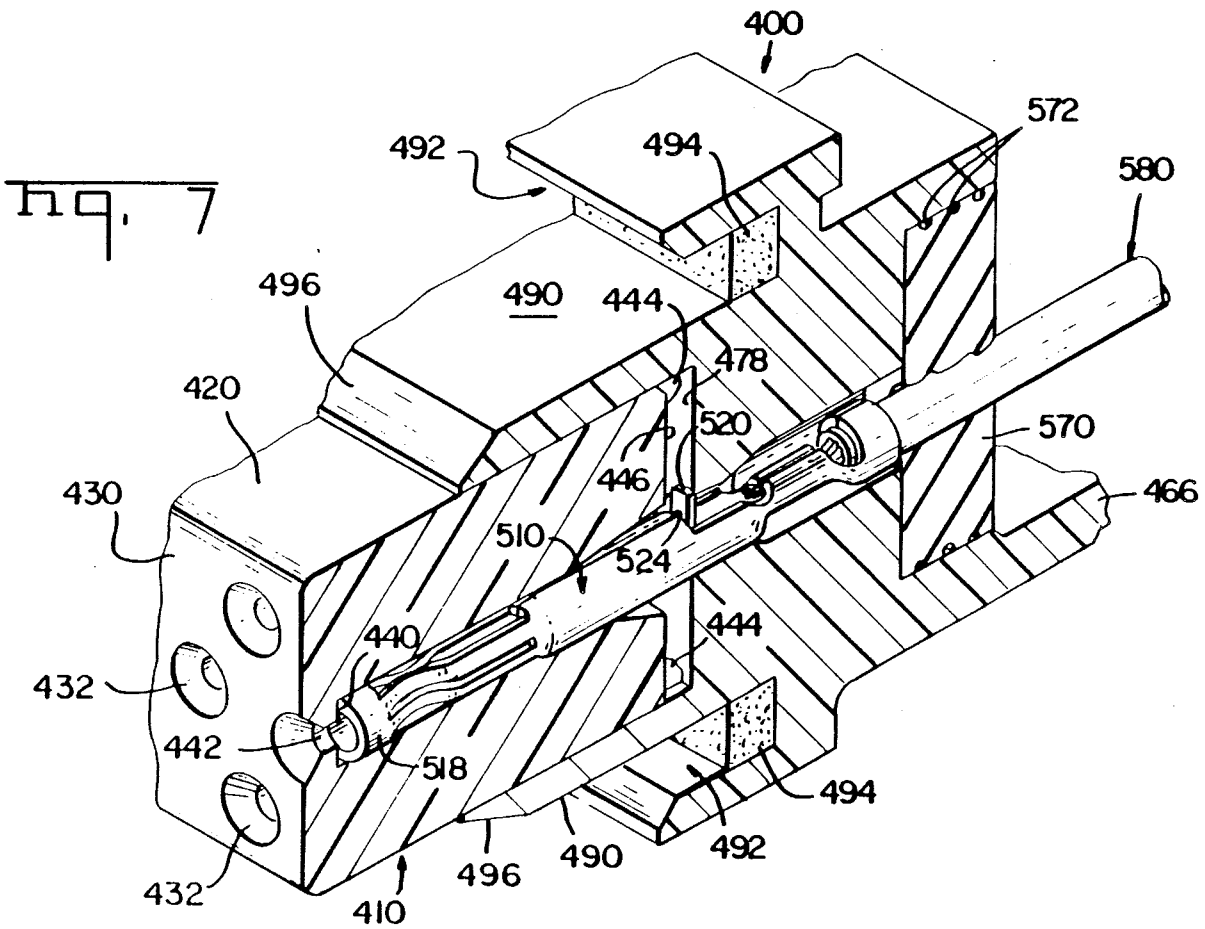

In order to install the contact 510 through the apertures in the rubber grommet, the lance end 520 should be enclosed within the envelope defined by the contact barrel portion 532 so as not to damage the grommet. As shown in FIG. 6, a pin, paper clip, or the like may be inserted in the pin-receiving area 512 and pushed rearwardly until the point of the pin contacts the lance 516 urging the lance end 520 downwardly through the lance opening 522 and into the envelope defined by the barrel portion 532. The contact 510, with the pin inserted, may then be placed through the grommet apertures 574 and through the contact receiving holes 480 in the plug housing 460 and through the contact receiving holes 434 in insert 410, as shown in FIG. 6. When the contact 510 is completely inserted, the socket end 518 abuts shoulder 440 in the insert 410, shoulder 440 providing a means to locate the forwardmost position of the contact 510. The pin which has been inserted in the contact 510 protrudes through the individual holes in the insert 410 and is now removed, which allows the lances to bias upwardly, placing the lance end 520 in the gap between the surface 446 of the insert and the surface 478 of the plug housing 460, as shown in FIG. 7. The contact is securely mounted within the insert and housing, as the contact end 518 abuts the respective shoulder 440 of the insert and the lance end 520 abuts the lance back stop 524 and the surface 478 of plug housing 460.

Once all the contacts are in place, the cover may be installed enclosing the rearward end of the plug housing 460, as best shown in FIG. 2. The latching tabs 542 may then be placed in respective slots (not shown) in the housing 460 and the latches 546 snapped over the mounting slots 464. A bundle tie 562 is then placed around the multiconductor cable and around the cover 540 and plug housing 460 providing for strain relief on the individual wires 580.

Although not part of the instant invention, the connector 2 and the printed circuit board 110 are mounted on a bulkhead 300, as shown in FIG. 1. The bulkhead 300, although shown as a wall, is actually one side of a box to be located locally for a system requiring the logic of the circuitry. The actual method of mounting the connector 2 and the plug housing 460 on the bulkhead 300 is determined by the configuration of the mounting face. In the preferred embodiment, the front mating face 502 of the plug housing 460 is planar, as shown in FIG. 2, whereas, in an alternate embodiment, the front mating face 502 includes bosses 504A.

Figure 11A:
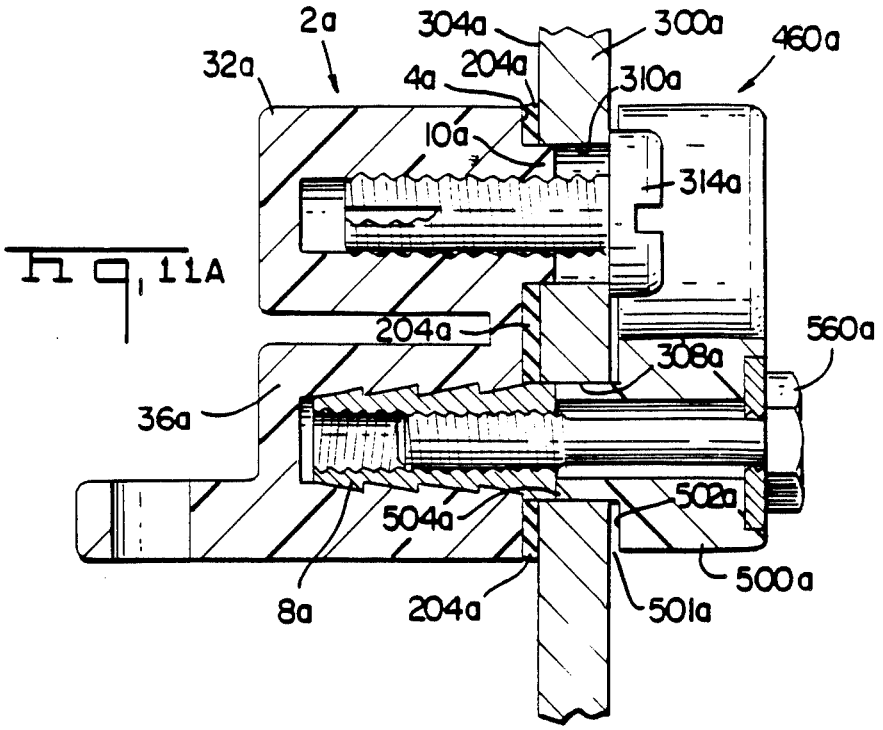
FIG. 11A shows a cross section of the alternate embodiment through the mounting holes of the receptacle and plug assembly.
Figure 11:
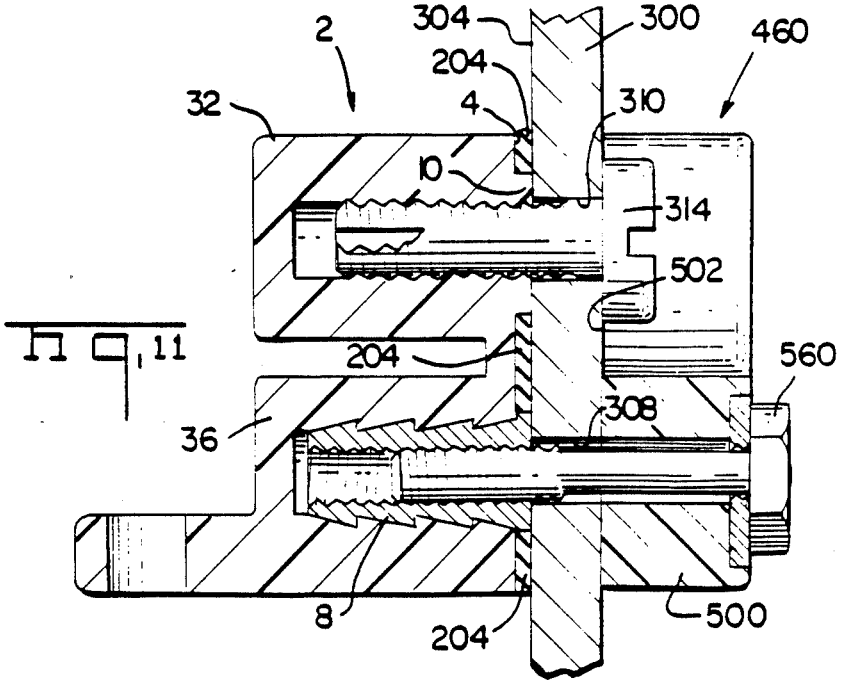
FIG. 11 shows a cross section of the preferred embodiment through the mounting holes of the receptacle and plug assembly.

When the mounting face 502 of the plug housing 460 is planar, the mounting face 502, will of course be mounted flushly with the bulkhead 300 outer surface, as shown in FIG. 11. The holes 308 and 310 for the insert 8 end boss 10, respectively, are dimensioned to receive the respective screws only, that is, the holes are not dimensioned to receive the insert 8 and boss 10. Rather, the front face of the insert 8 and the boss 10 bear directly on the bulkhead 300 back surface 304. The insert 8 and boss 10 are dimensioned so as to control the amount of gasket 204 squash. Thus, the height of the insert 8 and boss 10 is smaller than the undeformed thickness of the gasket 204. When the connector 2 is mounted to the back side of the bulkhead 300 by means of the self tapping screws however, the connector 2 will pull up towards the bulkhead and the gasket 204 will deform to the extent of the interference between the insert 8 and boss 10 and the backside of the bulkhead 300, as best shown in FIG. 11. When the plug housing 460 is also attached to the bulkhead 300, the machine screws 560 are placed through the housing and threaded within the inserts 8. As the machine screws 560 are tightened within the inserts 8, the insert is brought up against the backside of the bulkhead 300, and the facial friction between the insert 8 and the bulkhead 300, prevents the insert 8 from failing in a torsional mode, turning within the connector boss 36.

When the alternate embodiment is employed, as shown in FIG. 11A, the holes 308 and 310 within the bulkhead are dimensioned so as to receive the insert 8 and boss 10 therein, as shown in FIG. 11A. In this embodiment, the height of the insert 8A and boss 10A away from the face 4A, is greater than that in the preferred embodiment, as they extend into the respective holes 308A and 310A of the bulkhead 300.

When the plug 460A is inserted into engagement with the connector 2, and the machine screws 560A threaded into engagement with the inserts 8A, the bosses 504A are also brought into the hole 308A. Continued tightening of the machine screws 560A brings the faces of the bosses 504A to bear on the faces of the inserts 8A, leaving a gap 501A between the face 502A and the bulkhead 300A, as shown in FIG. 11A. In this case, as the screws 560A are tightened, the bosses 308A against the faces of the inserts 8A causes a frictional effect preventing the inserts 8A from failing by turning within the connector bosses 36A.

To seal the connector 2 and a printed circuit board 110 from any contaminants at the local interface, a seal 200 is placed between the connector mounting face 4 and between the bulkhead mounting face 304 the gasket portion 204 of the seal abutting the mounting face 304 of the bulkhead 300, as shown in FIG. 8. When the gasket 200 is placed onto the mating face 4 of the connector 2, the cylindrical portion 224 of the gasket extends into the gasket seat 24 of the connector 2. As the connector is drawn up to the bulkhead 300, by means of the self-tapping screws 314 (FIG. 1), the flat portion 204 of the gasket 200 undergoes a slight amount of crush between the surfaces 304 and 4 respectively.

Figure 9:
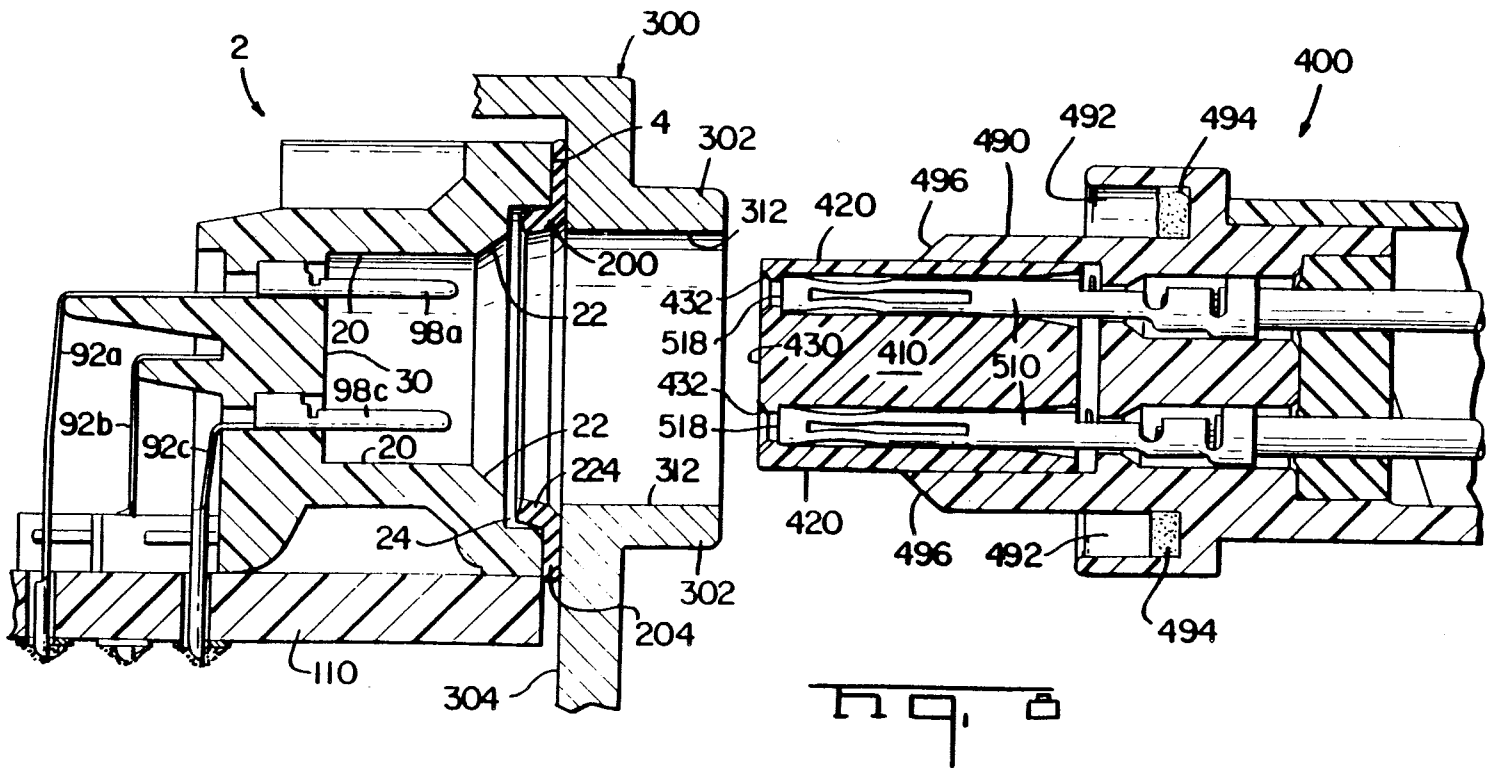
FIG. 9 shows the plug and receptacle partially assembled and the plug radially deforming the seal.
Figure 9:
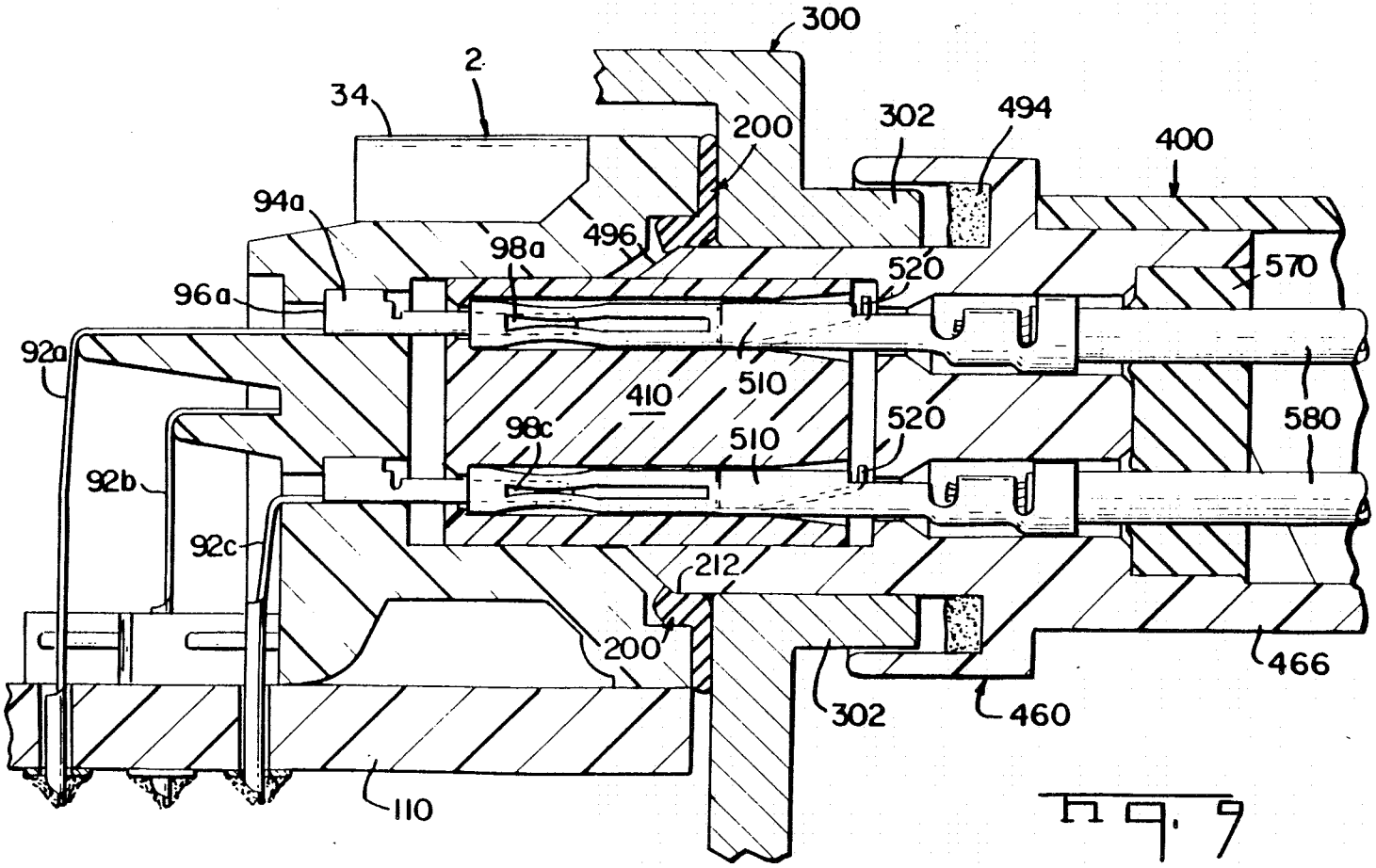
Figure 10:
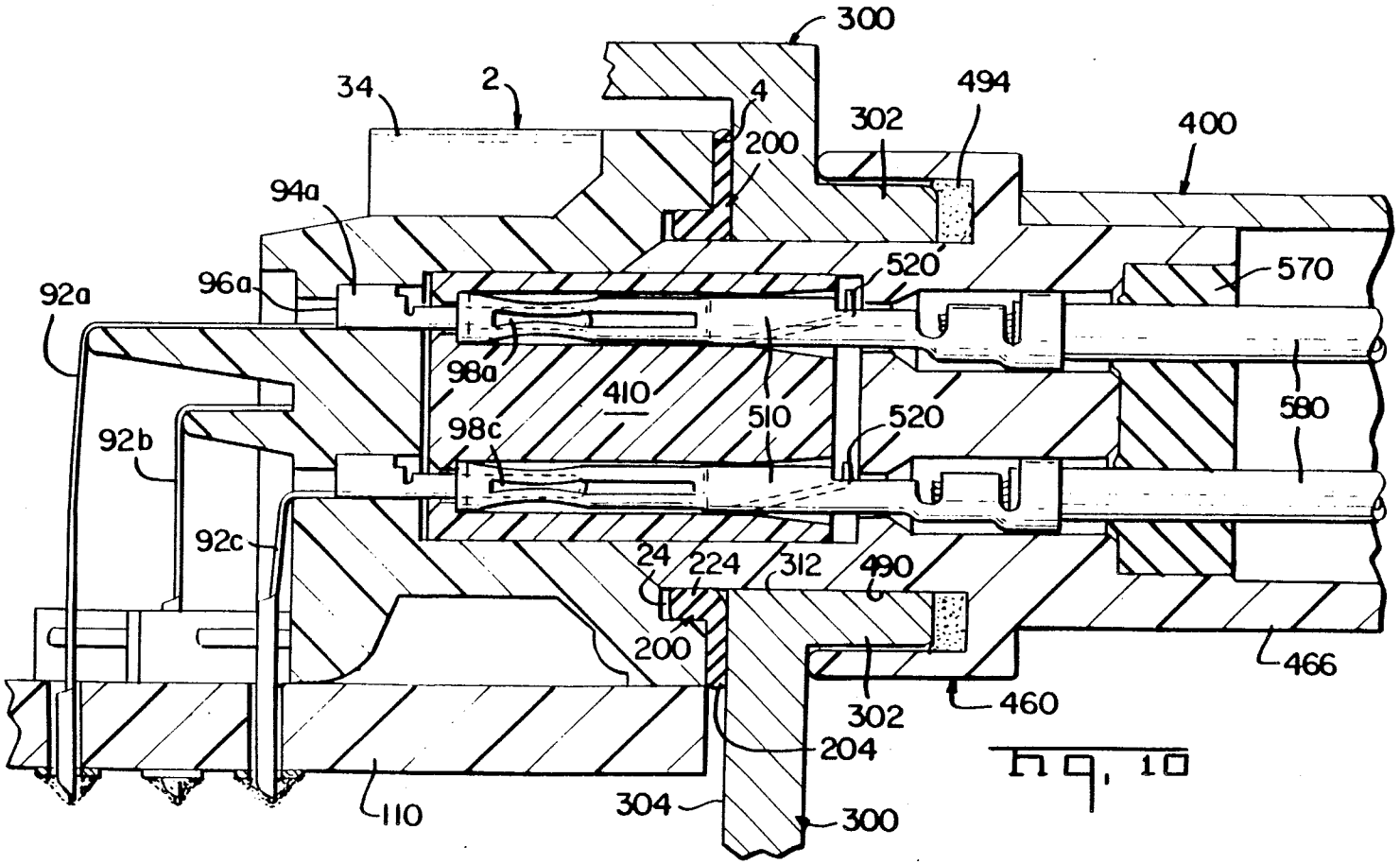
FIG. 10 shows the cross section of the preferred embodiment completely assembled.

As best shown in FIG. 8, as the plug assembly 400 is brought forward into the plug cavity 18, the contacts 98 are aligned with the socket ends 518 by means of the frustoconical lead-in sections 432. The peripheral surface 212 of the gasket 200 and the peripheral surface 490 of the plug 400 are dimensioned so as to create an interference fit between them, thus continued forward motion of the plug portion 400 results in contact between the lead-in surface 496 of the housing in the outer surface 212 of the gasket 200, as shown in FIG. 9. As the plug 400 continues inward, the lead-in portion 496 sequentially forces the surface 212 of the O-ring portion 224 radially outward, as shown in FIG. 9, which ultimately results in the surface 212 being planar or continuous with surface 312 and with surface 490, as shown in FIG. 10. When completely inserted, the front surface 430 of the insert 410 abuts back surface 30 of the cavity 18, and lead-in section 496 of the plug 400 abuts the lead-in section 22 of the connector 2 as shown in FIGS. 8 and 10. When the machines screws 560 (FIG. 1) are threaded into the inserts 8, and the plug 400 is drawn up to the bulkhead 300, the peripheral groove 492 extends over the flange 302, the forward surface of flange 302 abutting and squashing the seal 494 as shown in FIG. 10, providing a seal between the local environment and the socket contacts 510.

In the preferred embodiment, when the plug 400 is drawn up to the bulkhead 300, the mounting face 502 is mounted flush with the face of the bulkhead, as shown in FIG. 10. When the alternate embodiment is used, as shown in FIG. 10A, a gap 501A exists between the mounting face 502A of the plug housing 460A and the bulkhead 300A.

Figure 10A:
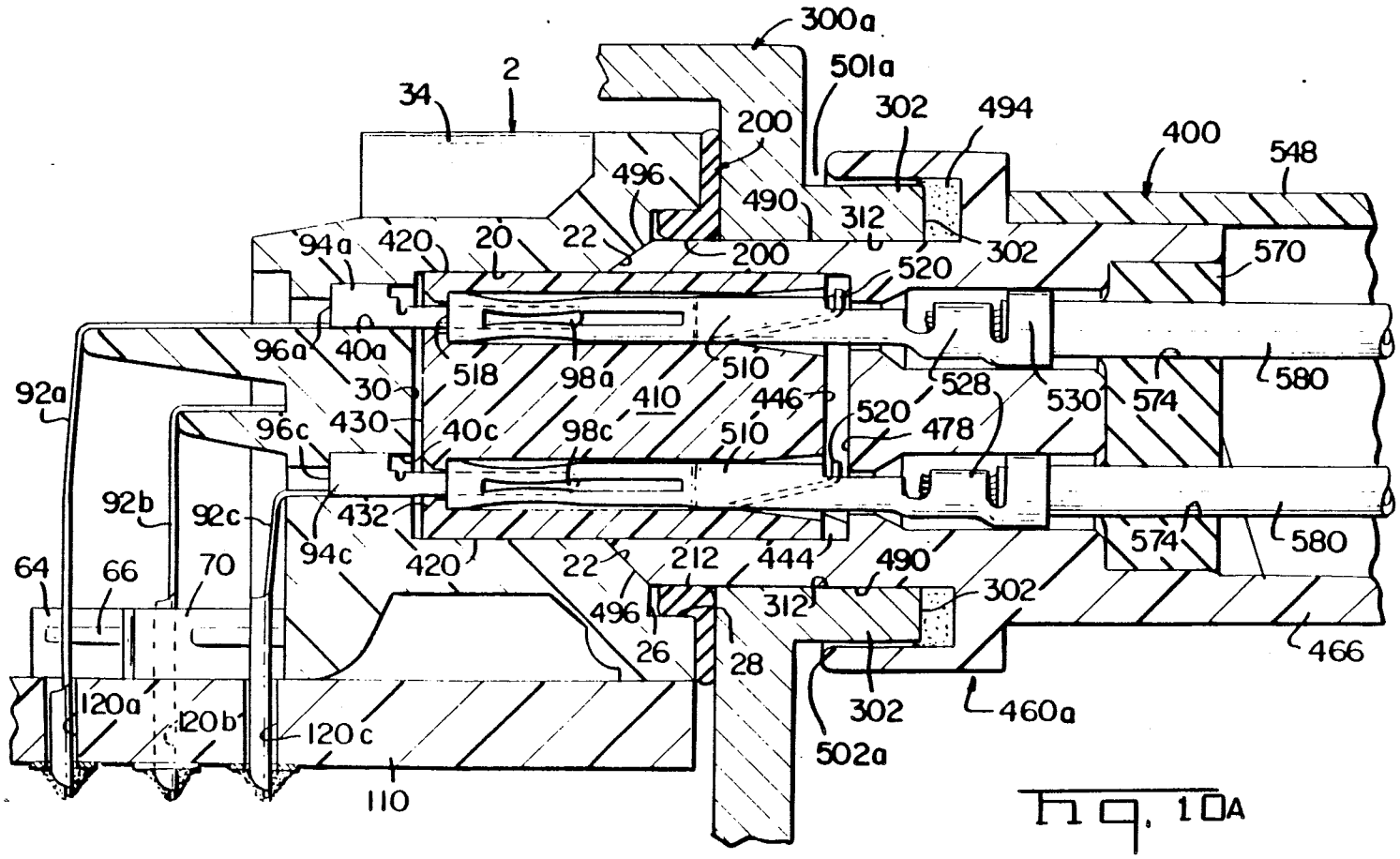
FIG. 10A shows the cross section of the alternate embodiment completely assembled.

When the plug portion is fully mated with the header, as shown in FIG. 10 or 10A, the pin contacts 98 are fully inserted in the constricted portion 514 of socket contact 510. As assembled the unit provides an exceptional vibration resistant plug and heater combination. As designed the socket contact 510 utilizes four resilient beam sections 515 inwardly biased between two band sections, the forward contact portion 518 and the contact barrel portion 532. Because the beam sections 515 are held at each end by the band portions, the beam sections cannot vibrate away from the pin causing an electrical discontinuity. Also, as the straight section of 438 of the insert 410 is closely toleranced to only allow a sliding fit of the contact front portion 518 and contact barrel portion 532, the contact 510 cannot unroll and cause a discontinuity between the pin portion 90 and the individual resilient beam sections of the constricted portion 514. Therefore, the socket contacts exhibit superior vibration resistance when utilized in a high vibration environment. Vibration can be excited in any plane of the contact or pin without causing either to vibrate thereby effecting an open circuit.

Furthermore, in either the preferred or alternate embodiment, the gasket 200 between the connector 2 and the bulkhead; the seal 474 between plug housing 460 and the bulkhead flange 302; the seal 570 within the plug housing 460; and the bundle tie 562 around the multi-conductor bundle of wires, all help to reduce the vibration from the bulkhead 300 to the socket contacts 98.

We claim:

1. A plug for interconnecting to a receptacle, the plug comprising:

a plug housing having a central portion including an insert receiving cavity therein, the cavity being defined by an inner peripheral surface and a back wall, the housing further comprising a first plurality of contact receiving apertures extending substantially between a rear contact receiving face of the central portion and the back wall within the cavity;

an insert profiled for receipt in said insert receiving cavity having a front and back planar surface and a second plurality of contact receiving apertures spaced as said first plurality of contact receiving apertures extending between said front and back planar surfaces, and a contact locating means disposed in each of said second plurality of contact receiving apertures, the insert and housing cooperatively comprising means for providing a gap therebetween;

a sealing means located adjacent and planar to the rear contact receiving face, having apertures aligned with said first and second contact receiving apertures;

and a plurality of electrical contact means profiled for axial placement through said sealing means and housing rear contact receiving face, into said first plurality of apertures and extending into said second plurality of apertures, the contact means comprising a mating end and a wire terminating end, the contact means further comprising an integral locking lance extending transversely of said contact means axial direction movable from a locked position extending outside of an envelope of the contact means, to an insertable position where the lance is within the envelope of said contact means, whereby when the lance of said contact means is in the insertable position and the contact means is inserted through the first and second contact receiving apertures until the mating end of said contact means abuts the contact locating means of said insert and the locking lance is moved to the locked position, the lance extends into the gap between the insert and housing, thereby locking the contact means in place.

2. The plug of claim 1 wherein the contact means comprise stamped and formed contacts having a forward cylindrical portion, an intermediate constricted portion, and a barrel portion.

3. The plug of claim 2 wherein said locking lance is struck from the barrel portion of said contact.

4. The plug of claim 2 wherein the contact means includes an opening in the barrel portion thereof, and the lance is struck from a side of the barrel portion opposite the opening to extend diagonally rearwardly into an interior of the barrel portion and through the opening.

5. The plug of claim 1 wherein the plug housing and insert cooperatively comprise retaining means for retaining said plug housing and insert together.

6. The plug of claim 2 wherein said locating means of said insert comprises contact receiving shoulders adjacent the front surface of said insert, facing the back surface of said insert, the diameter of said shoulders being smaller than the diameter of said forward cylindrical portion for retaining said contacts therein.

7. The plug of claim 1 wherein the means for providing a gap comprises standoff feet extending from said back planar surface of the insert to abut the back wall within the cavity.

8. A plug for matable connection to a receptacle mounted to a bulkhead wall, the receptacle having a plug receiving cavity recessed from the bulkhead wall on a receptacle mounting side and a plurality of contact pins arranged in a matrix within the cavity, the plug being mountable to a plug receiving side of the bulkhead wall which includes an opening therethrough in alignment with the plug receiving cavity and a shroud surrounding the opening, the shroud extending outwardly from the bulkhead wall on the plug receiving side, the plug comprising:

an insulative housing means having a forward portion defining a front mating face and a rear face, the housing means comprising a plurality of contact receiving apertures substantially extending between the front and rear faces, the housing means further comprising a flange means intermediate the front and rear faces, the flange means including a front face means, the housing means further comprising a peripheral groove on the flange means surrounding the forward portion, the groove being profiled for receiving the shroud of the bulkhead wall therein, the insulative housing means being profiled such that the forward portion is insertable through the opening in the bulkhead wall and into the plug receiving cavity until the front mating face abuts a back wall within said plug receiving cavity, and such that the front face means is contactingly engagable with the bulkhead wall;

first sealing means adjacent to the rear face in surrounding relationship with the apertures;

second sealing means disposed within the peripheral groove;

a plurality of contacts disposed within the apertures, each contact including a mating portion adjacent the front mating face and a terminating section for electrically connecting a conductor of an insulated wire thereto;

means to secure the front face means of the flange means against the plug receiving side of the bulkhead wall; and means to secure the plug to the receptacle; whereby when insulated wires are connected to the terminating sections of the contacts and the contacts are disposed within the contact receiving apertures, the plug is connectable to the bulkhead wall such that the shroud is disposed within the peripheral groove on the housing means deforming the second sealing means, and the first sealing means is disposed around individual insulation jackets of the insulated wires, the first and second sealing means providing a sealed environment for an interior portion of the housing means.

9. The plug of claim 8 wherein the rear face of the housing means includes a cavity means therein for receiving the first sealing means.

10. The plug of claim 9 wherein the cavity means is defined by a peripherally extending wall which surrounds the rear face.

11. The plug of claim 10 wherein the first sealing means comprises a one-piece seal having apertures aligned with the apertures in the housing means, and a peripheral edge which interferingly fits within the peripherally extending wall which surrounds the rear face.

12. The plug of claim 8 wherein the second sealing means is comprised of a foam material.

* * * * *